United States Patent [19]

Pasquazzi et al.

[11] Patent Number: 4,545,609

[45] Date of Patent: Oct. 8, 1985

[54] CURB LIFTING DEVICE

[76] Inventors: Henry Pasquazzi; Henry Pasquazzi, Jr., both of 464 Dyer Ave., Cranston, R.I. 02920

[21] Appl. No.: 564,039

[22] Filed: Dec. 21, 1983

[51] Int. Cl.[4] ..... B66C 1/44

[52] U.S. Cl. ..... 294/104; 294/106; 294/112

[58] Field of Search ..... 294/104, 111, 112, 107, 294/109, 106, 88, 118, 86, 14; 212/81, 84, 89, 127, 129; 37/183 R, 184, 185, 187; 414/395, 402, 747

[56] References Cited

U.S. PATENT DOCUMENTS 3,099,476 7/1963 Miller ..... 294/112

3,297,353 1/1967 Carlson ..... 294/106

*Primary Examiner*—James B. Marbert

*Attorney, Agent, or Firm*—Robert J. Doherty

[57] ABSTRACT

A curb lifting device including a frame adapted to be positioned over the top of a curb. The frame includes a fixed jaw as well as a movable jaw, the movable jaw being supported at the bottom of a pivotally mounted support. The first and second supports are provided with lever pairs which are upwardly pivotably movable at a center connection by means of a longitudinally extending shaft to which actuation means normally in the form of an upwardly movable cable is attached. The frame is initially positioned in its open position over the curb and thereafter upward force exerted upon the lever pairs centrally thereof so as to force the second support and its jaw into grasping contact with the opposite side of the curb.

4 Claims, 3 Drawing Figures

CURB LIFTING DEVICE

BACKGROUND OF THE INVENTION

This invention relates to a lifting device and in particular to a device adapted for lifting curbing sections such as those formed from concrete or cement and utilized adjacent roadways and the like. Such curbing sections are generally lifted into place by a three-man team including two men at the curb section itself and another man operating the lifting device such as a crane, backhoe, or the like from which a cable is attached to the curbing section via loops surrounding a cross-sectional portion thereof.

A number of devices to theoretically improve the lifting of curb sections or similarly shaped heavy articles have been divised and are set forth in the following patents: U.S. Pat. No. 1,888,083 to Holtz issued Nov. 15, 1932; U.S. Pat. No. 2,676,838 to Gardner issued Apr. 27, 1954; U.S. Pat. No. 2,851,300 to Trayer, Jr. issued Sept. 9, 1958; and West German Pat. No. 1,297,313 issued June 12, 1969. These patents illustrate devices while believed to be operational and capable of alleviating one or more of the various problems normally associated with lifting of such heavy devices still do not completely resolve the particular problems normally associated with the lifting of curb sections in a road constructional environment.

The desirable features of a device for lifting, manipulating, and setting curb sections include a structure which substantially directly overlies the top of the curb section such that it can be easily manipulated in place by one person especially in those cases where laterally disposed obstructions exist and, accordingly, holding devices which operate from a side position are not convenient. A further desirable feature of a device of this type is that it operates so as to grasp the curb section on opposed lateral sides thereof rather than either completely encircling or engaging at least a portion of the bottom curb surface. This feature is desirable as the bottom surface of curbing is not always readily accessible (as when repositioning previously positioned curbs) or when removal of the engaging device would be a problem.

These and other objects of the present invention are accomplished by a curb lifter having a frame including a top wall from which a first fixed support downwardly extends at one end thereof, said first support having a first jaw at the lower end thereof with said jaw provided with a substantially planar inner face for contacting one side portion of said curb, a second support downwardly extending from the other end of said top and provided with a second curb side portion contacting jaw at the lower end thereof such that said jaws are normally laterally spaced apart from each other in a relatively open position, said second support pivotally mounted with respect to said top such that its lower end may move towards said first support to a relatively closed second position wherein said jaws grasp said curb, actuation means for moving said second support to said closed position including first and second pairs of inwardly extending and respectively longitudinally spaced rigid lever arms respectively pivotally attached to said first and second supports and pivotally connected to each other by a rigid longitudinally extending generally centrally disposed main shaft, said lever pairs generally horizontally disposed in said open position and a lifting cable having its lower end extending downwardly through said top and in turn connected to said main shaft wherein upward movement of said cable forces the inner ends of said lever arms upwardly thereby shortening the distance between said lever arm pair support connections so as to in turn force said second support and the second jaw into said second closed grasping position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
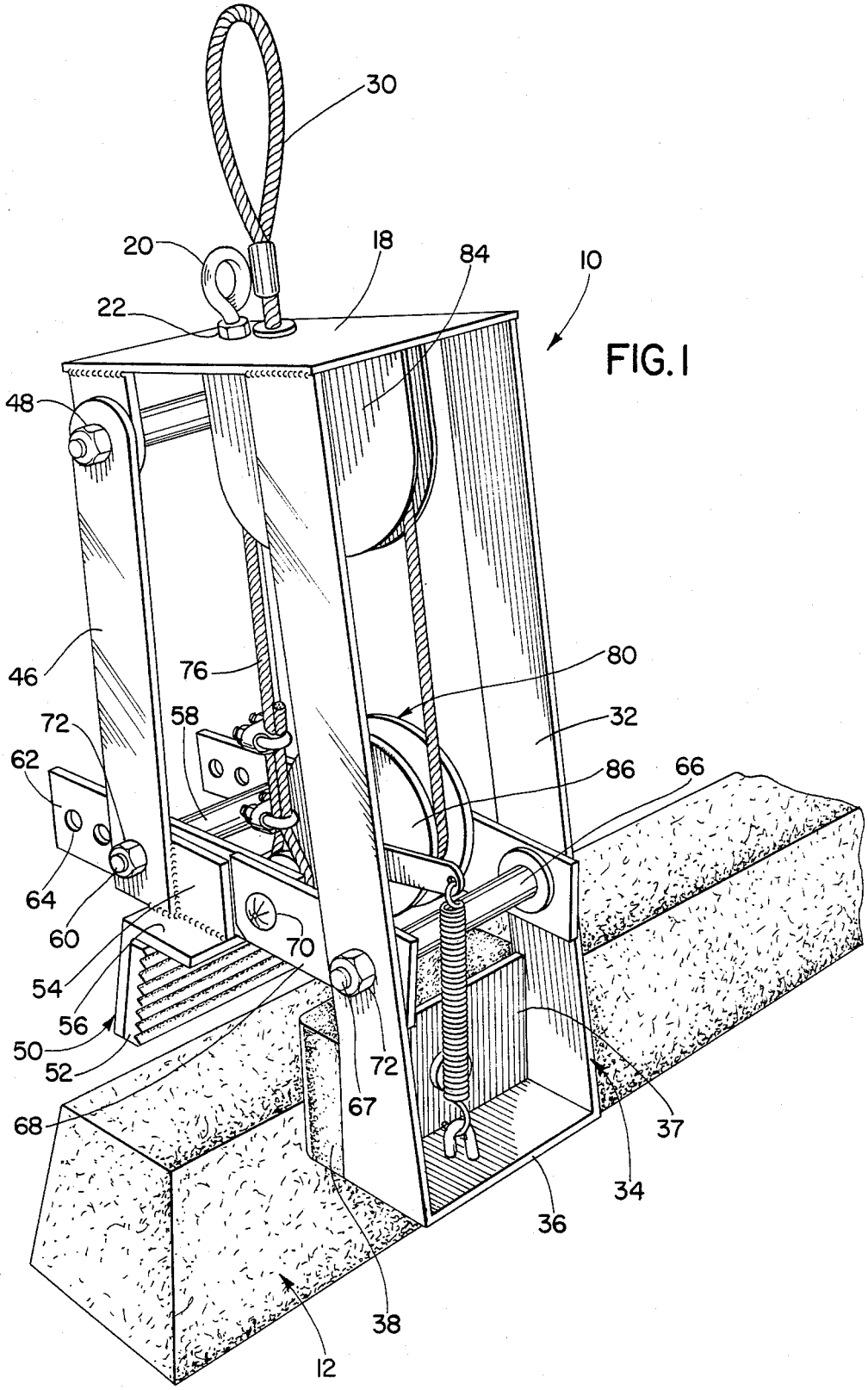
FIG. 1 is a perspective view showing a commercial form of the device of the present invention as it is adapted to be positioned over a curb section.

Turning now to the drawings, the device 10 of the present invention is illustrated in conjunction with a concrete curb section of generally trapeziodal cross-sectional configuration. It should be brought out that while the device 10 is particularly adapted for lifting such concrete curb sections 12, the invention has more widespread utility and that the curb or other article to be lifted may have a different cross-section so long as it exhibits generally laterally opposed vertically oriented side walls 14 against which the gripping jaws of the device 10 may co-act.

The device includes a frame 16 preferably of open construction and adapted to extend directly over the curb section 12. Such frame 16 includes a top plate or wall 18 of generally rectangular planar configuration and formed from constructional steel plate and the like. The remainder of the structural components forming the frame as hereinafter will be described may also be made from such suitable constructional materials. The top wall 18 is further provided with a eyelet 20 suitably secured thereto as by the attachment means illustrated including nuts 22 such that the device 10 may be suitably manipulated from one place to the other as by an elevating hook 24 attached to a suitable apparatus such as a backhoe, crane, or the like. The upper wall 18 is further provided with a generally central opening 26 through which the upper end 28 of a cable C may extend. Such cable upper end terminates in a loop 30 such that the apparatus may be actuated in the intended manner as will hereinafter be fully brought out.

The frame 16 further includes a pair of longitudinally spaced arms 32 downwardly extending from the top wall 18. These arms 32 are fixedly connected to the top wall as by welding or the like and cooperatively form a first support. The lower ends of the arms 32 terminate in a U-shaped bracket 34 which includes a base plate 36 and an upwardly extending front plate 37 to which a pad 38 adapted to contact the front side wall of the curb 12 is suitably connected as by adhesion or the like. The pad 38 is preferably formed of a high friction elastomeric material such as hard rubber or the like. The pad 38 as well as the lower portion of the front support cooperatively forms a front grasping jaw of the present device.

The rear of the top wall 18 is provided with a pair of longitudinally spaced downardly extending tabs 40 suitably secured thereto as by welding. Each of the tabs includes an opening 42 aligned with each other so as to receive a supporting pin or shaft 44. The ends of the shaft 44 extend through aligned openings in the upper ends of a pair of longitudinally spaced downwardly extending second arms 46. In this manner then the arms 46 which in part form the second or rear support of the device enables such second support to be connected to the upper wall 18 and provide for pivotal movement with respect thereto. The lower end of the second support is provided with a second jaw 50 to which a pad 52 of similar material to pad 38 is fixed. Such jaw 50 may be secured thereto by means of an intermediate plate 54 welded to both an upper wall portion 56 of the jaw 50 as well as to the lower portions of each of the downwardly depending arms 46.

Figure 2:
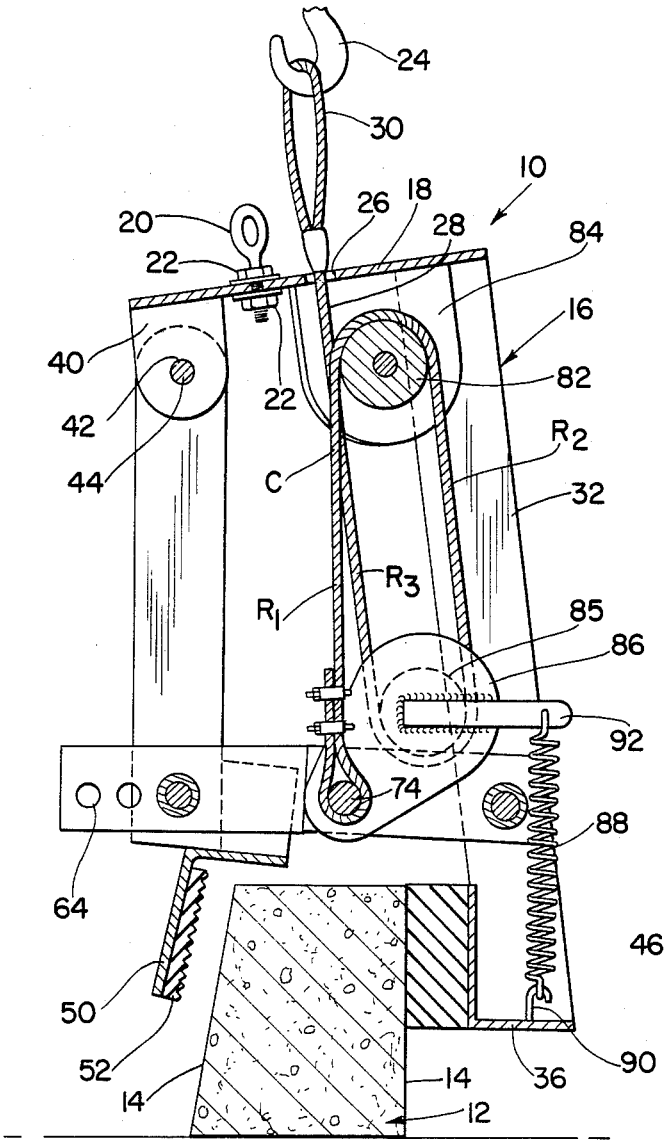
FIG. 2 is a similar side elevational sectional view thereof.
Figure 3:
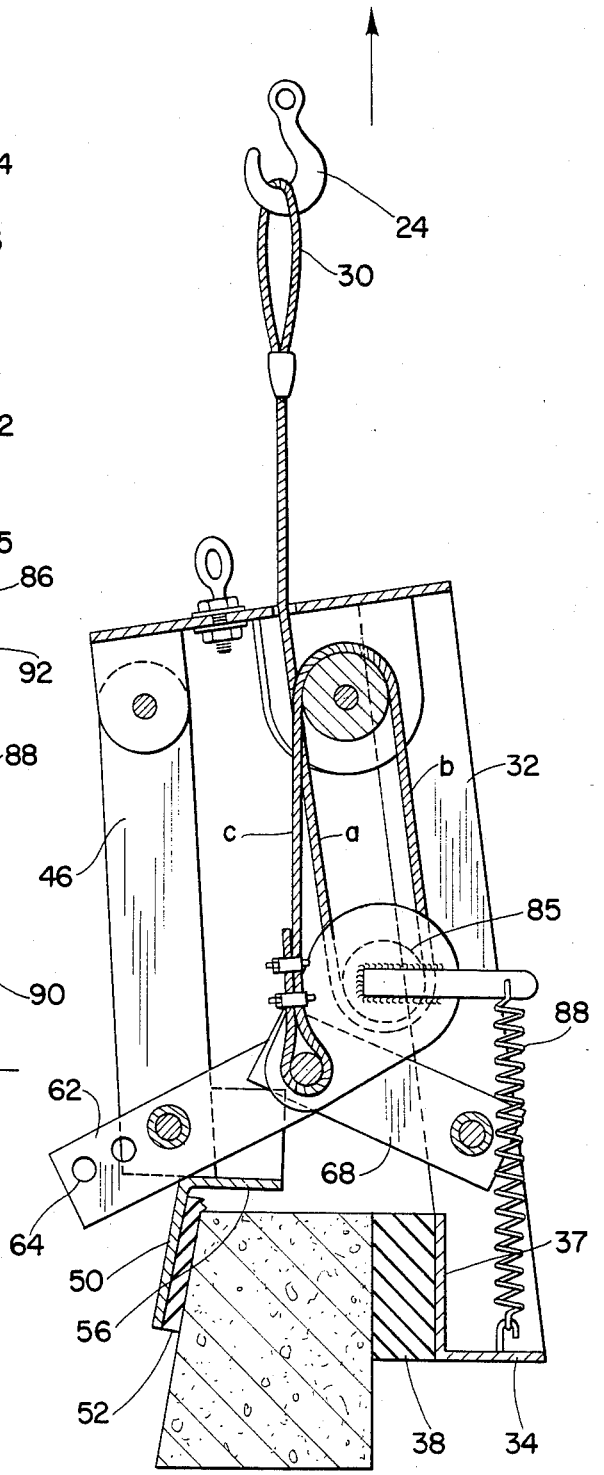
FIG. 3 is a side sectional view similar to FIG. 2 but showing the grasping elements or jaws of the device of the present invention in their closed lifting position.

In addition, the lower portion of each arm 46 is provided with an opening for a pin 58 longitudinally extending therebetween and terminating in treaded ends 60 which extend outwardly thereof. A laterally extending lever arm 62 (hereinafter referred to as the second lever arms) having a plurality of openings 64 provided therethrough is adapted for positioning from the inside portion of each of the arms 46 at a generally perpendicular position thereto such that the second lever arms 62 in their initial or open position such as shown in FIGS. 1 and 2 generally assunes a horizontal attitude. A similar arrangement is provided by a pin 66 extending between the fixed position arms 32. Such pin extends through a single opening in a pair of first lever arms 68 which inwardly extend, overlap, and are pivotally connected to a respective second lever arm 62 of the opposed pairs thereof by means of a pair of pin ends 70. The ends 60 and 67 of the pins 58 and 66 respectively are held in place by nuts 72 such that pivotal connection is provided for at both ends of the lever pairs as well as in the center. The longitudinal spacing between the jaws in the normally open or first position of the device 10 as shown in FIGS. 1 and 2 can be varied to accommodate various thickness curb sections by placing the pin ends 60 through a different opening 64 provided in the second lever arms 62.

The ends 70 are extensions of a main shaft 74 extending between the lever arm pairs centrally thereof so as to enable the lower end 76 of the cable C to be attached thereto. Thus lifting of the cable C upwardly once the front or fixed position jaw has been engaged with the front side of the curbing 14 forces the pairs of lever arms 62, 68 centrally upwardly in such a manner so as to force the second support which is pivotally mounted with respect to the remainder of the frame 16 inwardly or to the right as shown in the drawings so as to force the second or movable jaw 50 into contact with the opposite side of the curbing. Once such contact has firmly taken place further upward movement of the lever arms is prevented and further force upon the cable C in an upward direction will life the curbing and through such manipulation and grasping the curbing may be moved to its desired position and thereafter released by removing the upward force upon the cable C.

An actuation assembly 80 is provided so as to facilitate the upward movement of the main shaft 74 so as to provide for the aforementioned grasping and lifting action of the device 10 upon the curb 12. Such actuation assembly 80 includes a first pulley 82 supported in an upper position relative to the frame 16 and just below the upper plate 18 by means of a housing 84. This housing 84 is skewed, i.e., eccentrically positioned such that a first run R1 of the cable C moving from the main shaft 74 to the first pulley 82 is vertically oriented and a second run R2 downwardly extending from the first pulley 82 to a second pulley 85 is also generally vertically disposed. The eccentric mounting of the housing 84 accounts for the longitudinal displacement of the connection of the cable lower end 76 with the shaft 74 and the engagement of the cable second run R2 with the second pulley 85. The third run R3 of the cable upwardly moves from the second pulley 84 through the opening 26 in the top wall 18 and thence to the loop 30 as previously indicated.

The second pulley 85 is mounted on an offset or cam-shaped housing including a pair of spaced plates 86, the lower ends of which are pivotally connected to the main shaft 74 by means of spaced openings therethrough. The upper end of the plates 86 are downwardly urged by means of a spring 88 connected to the bottom of the first support as by attachment to a hook 90 in turn connected to the first jaw base plate 36. Such spring 88 is attached at its other end to a finger 92 in turn fixedly connected to one of the plates 86 as by welding or the like. This spring action insures that the second pulley 84 will be urged in a downward direction by insuring that some tension is placed on the individual runs R1 through R3 of the cable C so that undesirable slack will not take place therein.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A curb lifter adapted to grasp a longitudinally oriented curb from opposed upwardly oriented side portions thereof for the upward lifting thereof comprising a frame having a top wall from which a first fixed support downwardly extends at one end thereof, said first support having a first jaw at the lower end thereof with said jaw provided with a substantially planar inner face for contacting one side portion of said curb, a second support downwardly extending from the other end of said top and provided with a second curb side portion contacting jaw at the lower end thereof such that said jaws are normally laterally spaced apart from each other in a relatively open position, said second support pivotally mounted with respect to said top such that its lower end may move towards said first support to a relatively closed second position wherein said jaws grasp said curb, actuation means for moving said second support to said closed position including first and second pairs of inwardly extending and respectively longitudinally spaced rigid lever arms respectively pivotally attached to said first and second supports and pivotally connected to each other by a rigid longitudinally extending generally centrally disposed main shaft, said lever pairs generally horizontally disposed in said open position and a lifting cable having its lower end extending downwardly through said top and in turn connected to said main shaft wherein upward movement of said cable forces the inner ends of said lever arms upwardly thereby shortening the distance between said lever arm pair support connections so as to in turn force said second support and the second jaw into said second closed grasping position, said actuation means further including a mechanical advantaged pulley system engaged with said cable, said pulley system including an upper first pulley supported by and beneath said top wall proximal said fixed support and a lower second pulley supported by said main shaft disposed below said first pulley, said second pulley mounted in a position above said main shaft and offset towards said fixed support with respect to said main shaft, said cable end connected directly to said main shaft at a position laterally offset from said second pulley connection therewith, and said first pulley being eccentrically positioned so as to overlie the main shaft connection with both said cable end and said second pulley.

2. The curb lifter of claim 1, including spring means for urging said second pulley downwardly.

3. The curb lifter of claim 1, said cable end having a first run upwardly from its main shaft connection to said first pulley, a second run downwardly from said first pulley to said second pulley and a third run from said second pulley upwardly through said top wall.

4. The curb lifter device of claim 1, said supports each comprising a pair of longitudinally spaced arms downwardly extending from laterally opposed ends of said top wall, pins extending between said arms so as to interconnect said arms and support said levers for pivotal movement with respect thereto.

* * * * *